United States Patent [19]

Jungbluth

[11] 4,263,752

[45] Apr. 28, 1981

[54] FIRE RESISTANT GATE

[76] Inventor: Otto Jungbluth, Frankensteiner Strasse 99, 6100, Darmstadt-Eberstadt, Fed. Rep. of Germany

[21] Appl. No.: 973,593

[22] Filed: Dec. 27, 1978

Related U.S. Application Data

[63] Continuation-in-part of Ser. No. 874,877, Feb. 3, 1978, abandoned.

[30] Foreign Application Priority Data

Feb. 11, 1977 [DE] Fed. Rep. of Germany ..... 2705725

[51] Int. Cl.[3] ..... E06B 3/00

[52] U.S. Cl. ..... 49/501; 52/815; 52/799; 52/601; 52/309.17; 52/794

[58] Field of Search ..... 52/612, 600, 601, 309.15, 52/309.17, 792, 794, 799, 814, 815; 49/501

[56] References Cited

U.S. PATENT DOCUMENTS

| | | | |
|---|---|---|---|
| 2,934,934 | 5/1960 | Berliner | 52/612 X |
| 3,024,574 | 3/1962 | Sahlstrom | 52/794 X |
| 4,016,697 | 4/1977 | Ericson | 52/794 X |
| 4,069,629 | 1/1978 | Piazza | 52/612 X |

*Primary Examiner*—Kenneth Downey

*Attorney, Agent, or Firm*—Frishauf, Holtz, Goodman and Woodward

[57] ABSTRACT

A fire-resistant gate is disclosed which comprises a trapezoidally profiled steel sheet with punched thorny apertures, insulating layers on both side of the profiled steel sheet, and the outer face of the insulating layers being made of thin fiber reinforced cement layers. The advantage of the gate resides not only in the fact that the profiled steel sheet for bearing the vertical load is covered by the insulating layers and thus protected from fire, but also in that bearing capacity and stiffness of the gate are improved by the combination of expanded mineral-cement layers and thin fiber reinforced cement layers.

8 Claims, 6 Drawing Figures

FIRE RESISTANT GATE

CROSS REFERENCE TO RELATED APPLICATION

This application is a continuation-in-part of my copending application Ser. No. 874,877, filed Feb. 3, 1978 now abandoned.

BACKGROUND OF THE INVENTION

The invention relates to a fire-resistant gate, particularly a sliding gate comprising a trapezoidally profiled steel sheet with cement and polyurethane bonded expanded mineral layers on both sides thereof and the outer faces being made of thin fiber reinforced cement layers.

The known fire-protecting gates made of steel are formed, in general, from two walls and the inner portion therebetween is filled with insulating layer. They are so constructed that the steel parts facing the fire in the case of fire may be damaged, and the steel parts which are protected by the insulating layers will resist fire for the required duration. With such a construction, only half of the used material can support the load in the case of fire so that such construction is unnecessarily heavy, complicated and expensive.

SUMMARY OF THE INVENTION

It is an object of this invention to provide a fire-resistant gate bearing the vertical load in the case of fire and also being light, simple and lower in cost.

Other objects and advantages of the present invention will become apparent to those skilled in the art from the following description and drawings.

DESCRIPTION OF THE PREFERRED EMBODIMENT

The invention eliminates the above-mentioned disadvantages by forming the supporting construction from profiled steel sheet and providing the insulating layers on both sides thereof. The insulating layers comprise cement-bonded expanded mineral with a density of only 0.4 to 0.5 ton/m$^3$, said mineral normally being perlite.

A still lower density of 0.25 to 0.3 ton/m$^3$ can be obtained by adding polyurethane in a small amount not more than 10% by weight, and the rapid setting time desirable for the preparation can be obtained by the exothermic reaction. The fire-resistant class is at least T 90 for the insulation layers bonded not only with perlite-cement but also with perlite-cement-polyurethane.

Figure 3:
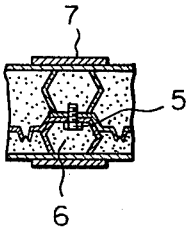
FIG. 3 is a cross-sectional view of one type of a joining part.
Figure 4:
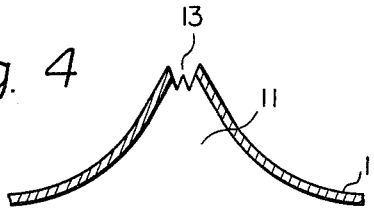
FIG. 4 is a longitudinal sectional view of a punched thorny aperture.

To improve the bond between the formed steel sheet and insulating layers on both sides thereof, a great number of closely spaced punched thorny apertures 11 (FIGS. 1, 2 and 3) are provided on the flange or base of the open trapezoidal-shaped profiled steel sheet, preferably alternately on both sides thereof (FIGS. 1 and 2), said punched thorny apertures 11 being conically shaped and their borders being indentated, as seen in FIG. 4. This indented form leads to claw- or barb-like engagement or catching between the steel sheet and the insulating layers and strengthens the bond. The barbs formed by the thorny apertures form a generally frustoconical shape and extend into the insulating layer to increase the shear strength between the insulating layer and the profiled steel sheet. The open area 13 at the top of the conical shape is so small that a flow-out of a insulating material is hardly possible.

The sandwiching action by virtue of three cooperating layers comprising (a) a profiled steel sheet reacting to pressure, (b) an expanded mineral-cement layer reacting to shear, and (c) a thin fiber reinforced cement layer reacting to tensile load constitutes the core of this invention. The advantages of the gate having this sandwich construction resides not only in the fact that the profiled steel sheet for bearing the vertical load is covered by the insulating layers and thus protected from fire, but also in the increase in bearing capacity and stiffness due to the combination of the expanded mineral-cement layers and tensile fiber-reinforced faces. The expanded mineral-cement layer itself has poor strength, while the bearing capacity of the profiled steel sheet is doubled by bonding the expanded mineral-cement layers, i.e. insulating layers, with a number of closely spaced punched thorny apertures and by providing the thin fiber reinforced cement layers on the outer face of the insulating layers.

Figure 5:
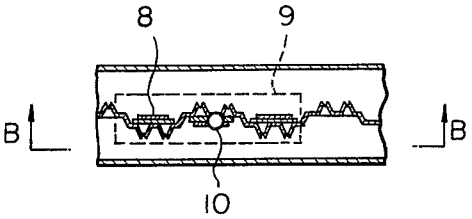
FIG. 5 is a cross-sectional view taken on lines C—C of FIG. 6 showing the parts of the hanging member of a fire-resistant gate.
Figure 6:
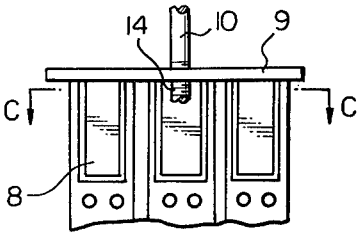
FIG. 6 is a longitudinal sectional view taken on lines B—B of FIG. 5 showing the parts of the hanging member of a fire-resistant gate.

A hanging member 10 (FIGS. 5 and 6) for a sliding gate is fixed by means of screws 14 (FIG. 6) to horizontal flat plate 9 which is placed over the upper end of the profiled steel sheet and which is welded to vertical hanger means or connecting sheets 8 connected on the upper portion of the flange of the profiled steel sheet.

Figure 2:
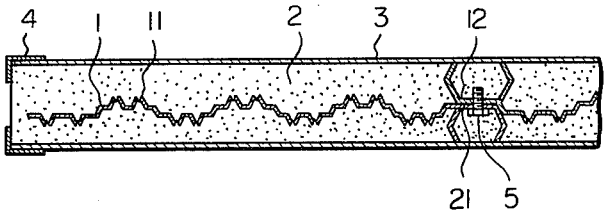
FIG. 2 is a cross-sectional view taken on lines A—A of the fire-resistant gate of FIG. 1.

The joining of adjoining profiled steel sheets, as shown in FIGS. 2 and 3, is effected by overlapping one flange 12 each thereof for vertical assembling, connecting them by means of plate screws 5 and filling the joining with the expanded mineral-cement.

Figure 1:
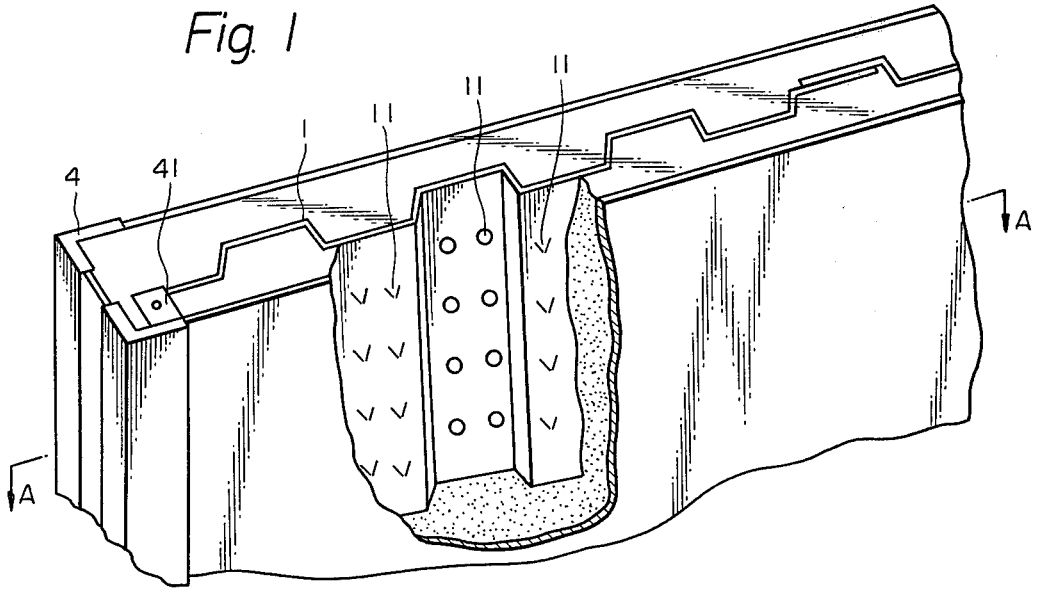
FIG. 1 is a perspective view showing a fire-resistant gate constructed in accordance with this invention, with parts thereof broken away.

In FIGS. 1 and 2, in order to absorb the undesirable tensile forces and impact stresses, the outer sides of the insulating layers 2 are provided with fiber reinforced thin cement layers 3 such as thin glass mat reinforced cement layers. Similarly, the outer edges are protected against impact by steel sheet corner angles such as angled metal guards 4 and U-shaped profile metal guards which have no meaning for fire resistance. The steel sheet corner angles are connected with the profiled steel sheet 1 by staggeringly distributed anchoring steel angles 41.

In FIG. 3, there is illustrated a joint in which the space is filled with mineral wool 6 and covered with two overlapping fire-protecting plates 7.

What is claimed is:

1. A fire-resistant gate comprising:

a vertically oriented profiled steel sheet defining a plurality of adjacent open trapezoidal cross-sectional shaped portions, adjacent open trapezoidal cross-sectional shaped portions opening in opposite directions, said trapezoidal shaped portions of said profiled steel sheet each comprising a vertically extending base portion;

a plurality of closely spaced generally conically shaped thorny apertures punched out of the base portions of said trapezoidal shaped portions, said punched thorny apertures in adjacent base portions of said trapezoidal shaped portions being punched out alternately from opposite sides of said profiled steel sheet so that said generally conically shaped thorny apertures extend from adjacent base portions in respective opposite directions;

a plurality of vertical hanger means connected on the upper portion of said vertically extending base portions, said hanger means being connected to said base portions on sides thereof opposite to the directions in which said punched thorny apertures extend from said base portions;

a horizontal flat plate mounted over the upper end of said profiled steel sheet and being welded to said vertical hanger means;

a member fixedly attached to said horizontal flat plate for hanging a sliding gate;

an insulating layer bonded to each opposed side of said profiled steel sheet, said insulating layers each being an expanded mineral-cement having a density of from about 0.25 to about 0.5 ton/$m^3$, said expanded mineral-cement including a mixture of perlite, cement and polyurethane, the weight of said polyurethane in said mixture not exceeding 10% by weight of the respective insulating layer, said conically shaped thorny apertures in said base portions of said profiled steel sheet penetrating into said insulating layers; and thin fiber reinforcement cement layers bonded to the outer faces of said insulating layers.

2. A fire-resistant gate according to claim 1 wherein the fiber of said thin fiber reinforced cement layers is a glass mat.

3. A fire-resistant gate according to claim 1 wherein the edges of the gate are protected by steel sheet corner angles, said angles being out of direct contact with each other, and being connected with said profiled steel sheet by staggered anchoring steel angles.

4. A fire-resistant gate according to claim 1 wherein said punched thorny apertures each comprise a punched generally conically shaped protrusion formed in said profiled sheet, said punched protrusions each having wall portions extending from the base portion of said profiled sheet, said conical protrusions each having open ends at the end of said wall portions, said open ends defining said thorny apertures, said wall portions penetrating into said insulating layer and improving the shear strength between said insulating layer and said profiled steel sheet.

5. A fire-resistant gate according to claim 4 wherein said wall portions define a substantially frusto-conical shape and extend at about 45 degrees from the surface of said profiled steel sheet.

6. A fire-resistant gate according to claim 1 wherein said punched thorny apertures are provided only on the base portions of said trapezoidal profiled sheet.

7. A fire-resistant gate according to claim 1 wherein said punched thorny apertures are substantially frusto-conical in shape.

8. A fire-resistant gate according to claim 7 wherein said frusto-conical punched thorny apertures have wall portions which extend from the surface of said profiled steel sheet at about 45 degrees.

* * * * *